US007258055B1

(12) United States Patent
Javorsky

(10) Patent No.: US 7,258,055 B1
(45) Date of Patent: Aug. 21, 2007

(54) MACHINE GUN MOUNT

(75) Inventor: David Javorsky, Dingsmans Ferry, PA (US)

(73) Assignee: United States of America as Represented by the Secretary of the Army, Washington, DC (US)

( * ) Notice: Subject to any disclaimer, the term of this patent is extended or adjusted under 35 U.S.C. 154(b) by 749 days.

(21) Appl. No.: 10/709,044

(22) Filed: Apr. 8, 2004

Related U.S. Application Data

(60) Provisional application No. 60/481,445, filed on Sep. 30, 2003.

(51) Int. Cl.
*F41A 23/00* (2006.01)

(52) U.S. Cl. ..... 89/37.01; 89/37.03; 89/37.11; 89/37.16; 42/94; 42/98

(58) Field of Classification Search ..... 89/37.01, 89/37.03, 37.16, 37.11, 41.22; 42/94, 98
See application file for complete search history.

(56) References Cited

U.S. PATENT DOCUMENTS 2,415,153 A * 2/1947 Trimbach et al. ..... 89/33.4
6,283,428 B1 * 9/2001 Maples et al. ..... 248/282.1
6,286,411 B1 * 9/2001 Sanderson ..... 89/37.16
6,393,960 B1 * 5/2002 Bilger ..... 89/37.03

* cited by examiner

*Primary Examiner*—J. Woodrow Eldred
(74) *Attorney, Agent, or Firm*—Michael C. Sachs; John F. Moran

(57) ABSTRACT

A machine gun mount is provided for mounting a machine gun in a movable support arm of a helicopter. The mount includes a gun cradle which is detachably connected to the gun and a pintle one end of which is adapted to pivotably mount the pintle, and thus the mount, on the movable support arm. This enables pivoting movement of the gun in a horizontal plane. The pintle is pivotably connected at the opposite end to the cradle so as to permit the cradle, and thus the gun, to be rotated in a vertical plane through 90 degrees between operative and stowed positions. A locking mechanism locks the cradle in the stowed position. A magazine is attached to one side of the cradle while a spent case and link frame and associated catch bag are attached to the opposite side. The magazine includes an inwardly projecting portion disposed below the cradle.

12 Claims, 2 Drawing Sheets

MACHINE GUN MOUNT

CROSS REFERENCE TO RELATED APPLICATIONS

This application claims benefit under 35 USC 119(e) of provisional application 60/481,445, filed Sep. 30, 2003, the entire file wrapper contents of which provisional application are herein incorporated by reference as though fully set forth at length.

FEDERAL RESEARCH STATEMENT

The inventions described herein may be manufactured, used and licensed by or for the U.S. Government for U.S. Government purposes.

BACKGROUND OF INVENTION

It will be appreciated that there are obvious advantages to being able to stow a machine gun completely within a helicopter without breaking down the machine gun or removing the components parts. Existing machine gun mounts for helicopters such as the UH-60 Black Hawk Helicopter cannot be stowed away because of interference problems with the crew seat, fire extinguisher and the inside of the fuselage. The existing mounting system also fails to meet weapon dispersion requirements. A further disadvantage of the existing system is that the system magazine has limited capacity (200 rounds) and the spent case catch bag interferes with the machine gun mount post making it difficult to transverse the post as the catch bag fills with empty cases and links.

SUMMARY OF INVENTION

In accordance with the invention, there is provided a machine gun mounting arrangement our mount which enables mounting of a machine gun, such as the M240 machine gun, on a helicopter and which also enables the machine gun to be completely stowed within the helicopter without removing any component parts and without any interference with existing components of the aircraft (such as the inside of the fuselage) or with other stowed equipment (such as a fire extinguisher) or with the aircraft crew members (e.g., by interfering with the crew seat).

In accordance with one aspect of the invention, there is provided a machine gun mount for mounting a machine gun in a movable support arm of a helicopter, the mount comprising:

a gun cradle adapted to be detachably connected to a machine gun;

a pintle including means at one end thereof adapted to pivotably mount the pintle, and thus the mount, on the movable support arm so as to enable pivoting movement of the mount, and thus a machine gun mounted in the gun cradle, in a horizontal plane, said pintle being pivotably connected at an opposite end thereof to said gun cradle so as to permit the gun cradle, and thus a machine gun mounted in the gun cradle, to be rotated in a vertical plane through 90° between a first, operative position and a second, stowed position;

locking means for locking the gun cradle in the stowed position;

a magazine attached to one side of the gun cradle;

a spent case and link frame attached to the opposite side of the gun cradle;

a spent case and link catch bag connected to and supported by said frame; and a spend case and link deflector supported by said mount and disposed so as to deflect spent cases and links ejected from a machine gun mounted in the gun cradle away from the machine gun to one side thereof.

In accordance with an important feature, the magazine includes a lower inwardly projecting portion disposed below the cradle.

Preferably, the gun cradle includes first and second axially spaced mounting elements on said one side and the magazine includes a pair of mounting brackets secured to the mounting elements.

The gun cradle preferably includes first and second transversely spaced lugs adapted to support a machine gun on the mount.

Advantageously, the gun cradle includes transversely spaced first and second mounting members extending oppositely from said first and second lugs for supporting said opposite end of the pintle.

In accordance with a further aspect of the invention, there is provided a machine gun mount for mounting a machine gun in a movable support arm of a helicopter, the mount comprising:

a gun cradle adapted to be releasably connected to the machine gun;

a pintle including means at one end thereof adapted to pivotably mount the pintle, and thus the mount, on the movable support arm so as to enable pivoting movement of the mount, and thus a machine gun mounted in the gun cradle, in a horizontal plane, said pintle being pivotably connected at an opposite end thereof to said gun cradle so as to permit the gun cradle, and thus a machine gun mounted in the gun cradle, to be rotated in a vertical plane through 90° between a first, operative position and a second, stowed position;

retaining means for retaining the gun cradle in the stowed position;

a magazine attached to one side of the gun cradle, said magazine including a lower inwardly projecting portion disposed below said cradle;

a spent case and link frame attached to the opposite side of the gun cradle; and a spent case and link bag connected to and supported by said frame.

Preferably, the gun cradle includes first and second transversely spaced lugs and cooperating quick release pins adapted to releasably connect a machine gun to the mount.

According to yet another aspect of the invention, there is provided a machine gun mount for mounting a machine gun in a movable support arm of a helicopter, said mount comprising:

a gun cradle adapted to be detachably connected to a machine gun, said cradle including first and second axially spaced mounting elements on said one side and first and second transversely spaced lugs adapted to support the machine gun on the mount;

a pintle including means at one end thereof adapted to pivotably mount the pintle, and thus the mount, on the movable support arm so as to enable pivoting movement of the mount, and thus a machine gun mounted in the gun cradle, in a horizontal plane, said pintle being pivotably connected at an opposite end thereof to said gun cradle so as to permit the gun cradle, and thus a machine gun mounted in the gun cradle, to be rotated in a vertical plane through 90° between a first, operative position and a second, stowed position;

locking means for locking the gun cradle in the stowed position;

a magazine attached to one side of the gun cradle, said magazine including a lower inwardly projecting portion disposed below said gun cradle and said magazine further including a pair of mounting brackets secured to said mounting elements of said gun cradle;

a spent case and link frame attached to the opposite side of the cradle mount;

a spent case and link bag connected to and supported by said frame.

Further features and advantages of the present invention will be set forth in, or apparent from, the detailed description of preferred embodiments thereof which follows.

DETAILED DESCRIPTION

Figure 1:
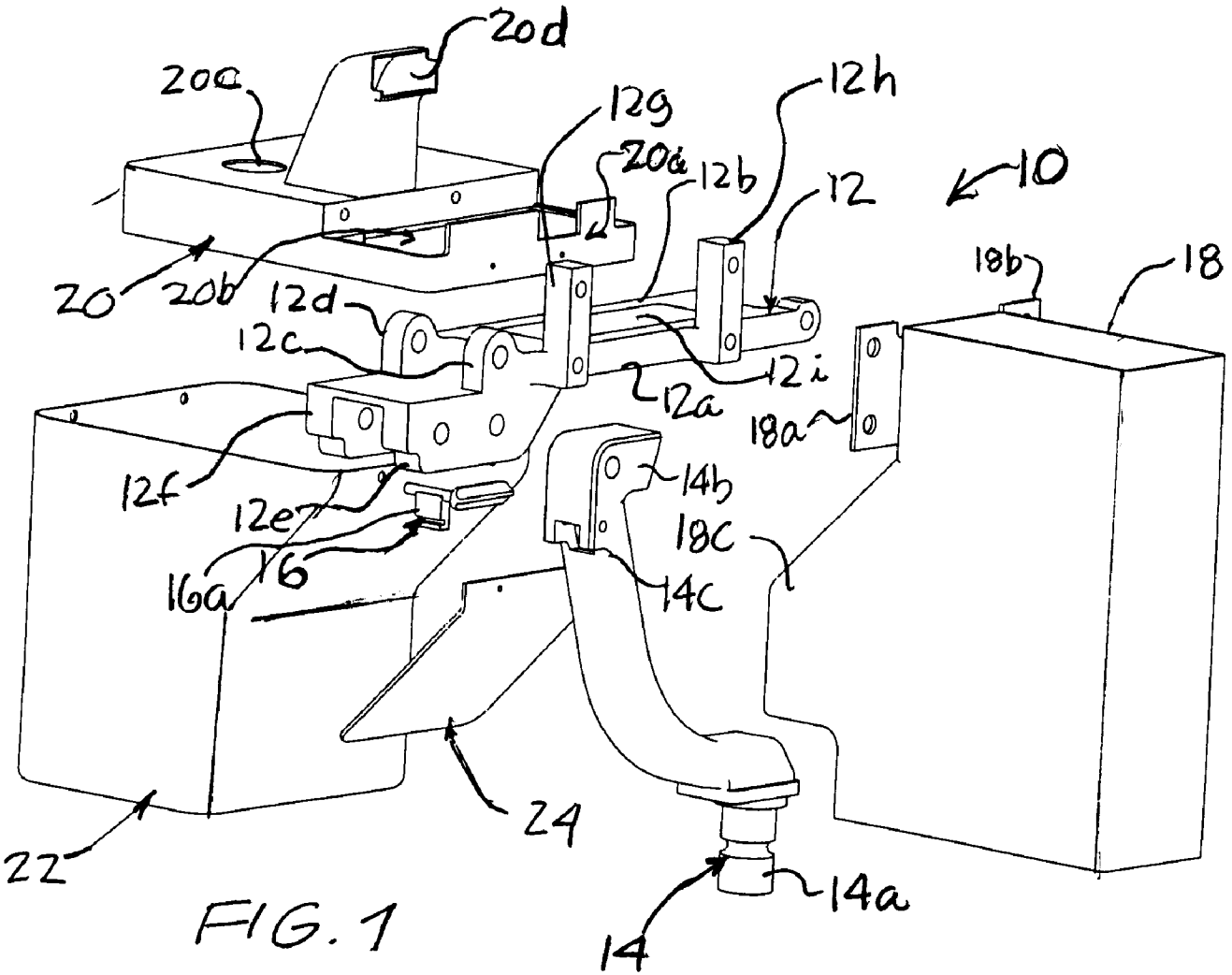
FIG. 1 is an exploded perspective view of a weapon mount constructed in accordance with a preferred embodiment of the invention.
Figure 2:
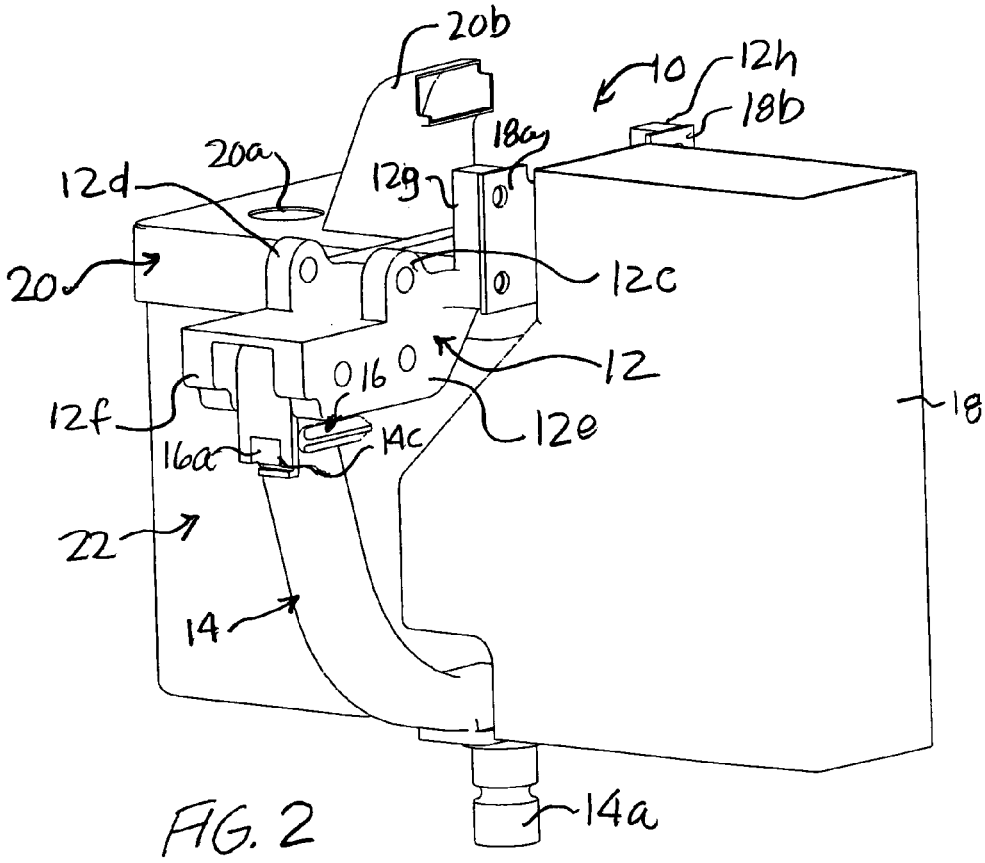
FIG. 2 is a perspective view of the mount of FIG. 1, in an assembled state.

Referring particularly to FIGS. 1 and 2, there is shown a machine gun mount constructed in accordance with a preferred embodiment of the invention. The mount, which is generally denoted 10, includes the following major components which are best seen in the exploded perspective view provided in FIG. 1; a gun cradle 12; a pintle 14; a travel lock mechanism 16; a magazine 18; a spent case and link frame 20; a spent case and link frame catch bag 22; and a spent case deflector 24, all of which are described in more detail below.

The gun cradle 12 acts as the interface between the machine gun (not shown in FIGS. 1 and 2 but denoted MG in FIG. 3) and the other mount components. Cradle 12 is preferably a casting made of a high strength steel. The cradle 12 includes parallel body portions 12*a* and 12*b* which define a pair of upwardly extending (as viewed in FIG. 1) lugs 12*c* and 12*d* and a pair of downwardly extending (as viewed in FIG. 1) lugs 12*e* and 12*f*.

Figure 3:
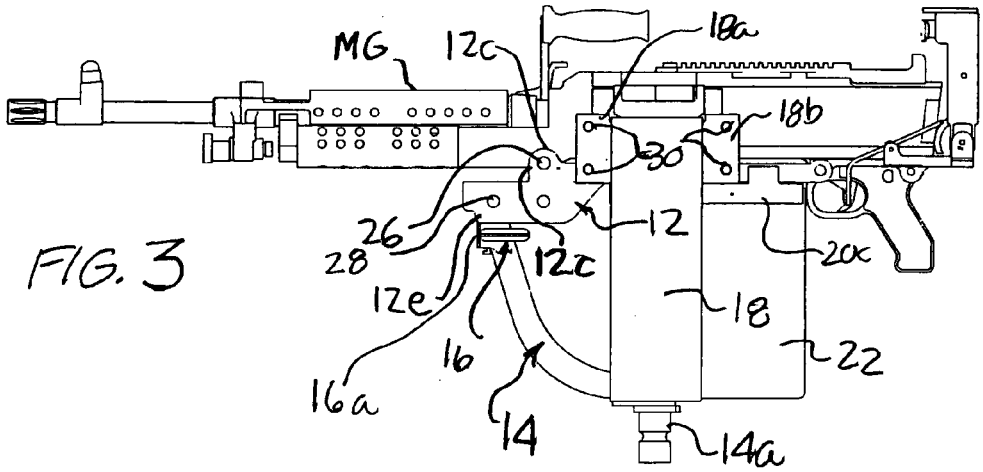
FIG. 3 is a side elevational view of the mount of FIGS. 1 and 2, showing a machine gun mounted thereon.

Upper lugs 12*c*, 12*d* support the machine gun MG as shown in FIG. 3, with gun MG being attached thereto with two quick release pins (one of which denoted 26 is shown in FIG. 3).

Lower lugs 12*e* and 12*f* pivotably support one end of pintle 14 as is shown in FIGS. 2 and 3 and as is described in more detail below.

Portion 12*a* of cradle 12 also includes a pair of upright or outwardly extending mounting elements 21*g* and 12*h* located on one side of cradle 12. Mounting elements 12*g*, 12*h* are used to support magazine 18, as is perhaps best seen in FIG. 2, and as is described in more detail below.

An opening 121 defined by (between) portions 12*a* and 12*b* of cradle 12 is adapted to be disposed below the case and link ejector region of machine gun MG as is discussed in more detail below.

Turning to pintle 14, pintle 14 serves as the interface between the gun cradle 12 and a movable arm (not shown) for mounting the machine gun MG. For the machine gun used on a UH-60 Black Hawk helicopter, the arm (not shown) is a M144 arm attached to the window frame (not shown) of the helicopter. This arm arrangement is conventional and forms no part of the present invention.

A pivot element 14*a* at the lower end of pintle 14 is pivotably received in the above-mentioned movable arm (not shown) so that pintle 14 can pivot in the arm so as to allow machine gun MG to be pivoted horizontally, i.e., traversed in the horizontal plane.

The cradle 12 is connected to the top end 14*b* of pintle 14, and in a preferred embodiment, a quick release pin 28 (see FIG. 3) is used to connect the pintle 14 to lugs 12*e*, 12*f* of cradle 12. Pin 28 provides a pivot axis which allows the machine gun MG to be vertically elevated and depressed, i.e., rotated in the vertical plane. The pintle 14 has a depression limit of 90 degrees (in contrast to the about 70 degrees of depression permitted by the existing mounts mentioned above), and this feature enables the machine gun MG to be stowed completely inside the aircraft and away from the operator (in contrast to the existing mounts wherein, because of the depression limit of about 70 degrees, the gun, when stowed, would not clear the operator's seat).

A recess 14*c* at the upper end 14*b* receives a tab 16*a* of the travel lock mechanism 16. As is perhaps best seen in FIG. 1, travel lock mechanism 16 is of a generally L-shaped configuration with tab 16*a* being disposed on one leg of the L. When the machine gun MG is fully depressed, a tab (not shown) in the gun cradle 12 moves into the pintle 14 and travel lock tab 16*a* is rotated 90 degrees so as to engage in a locking position and thus lock the machine gun MG in a vertical, muzzle down position for stowage.

Although the use of a travel lock mechanism such as travel lock mechanism 16 has important advantages, other locking or retaining means can be used.

Turning to the magazine 18, as indicated above, magazine 18 is attached to the gun cradle 12 and includes a pair of mounting brackets 18*a* and 18*b* for this purpose.

In a preferred embodiment, four bolts 39 (see FIG. 3) and associated washers (not shown) are used to connect brackets 18*a*, 18*b* to mounting elements 12*g*, 12*h*, with the bolts 30 extending through aligned holes in brackets 18*a*, 18*b* and in mounting elements 12*g*, 12*h*. The shape or configuration of magazine 18 is important and, in this regard, an inwardly extending portion 18*c* is provided which maximizes capacity while minimizing the space required by occupying some of the space under the cradle 12. In a preferred embodiment, magazine 18 has a capacity of 300 linked rounds and is made of sheet steel.

The spend case and link frame 20 is basically conventional and is attached to cradle 12 by means of the inwardly extending portion 20*a* in which part of cradle 12 rests, using four attaching bolts (not shown). Portion 20*a* defines an opening 20*b* in alignment with the central opening 121 in gun cradle 12 through which spent cases and links fall after being ejected from machine gun MG. The frame 20 is preferably a sheet steel weldment. Two holes 20*c* and 20*d* in the top of frame 20 enable the operator to quickly determine whether the spent case bag 22 is full and thus needs emptying. Again, the frame 20 is similar to an existing frame in an existing mount.

The spent case and link catch bag 22 is also similar to many existing catch bags. The bag 22 attaches to frame 20 as shown in FIGS. 2 and 3. Bag 22 is preferably made of canvas and preferably includes a hooks and loops (VELCRO®) closure at the bottom thereof for quick emptying when full. In the preferred embodiment under consideration, the bag 22 is designed to hold at least 300 cases and links.

The spent case deflector 24, which is preferably constructed of sheet metal, is attached to the innermost wall of portion 20*a* of frame 20 with two attaching bolts (not shown). Deflector 24 is used to deflect empty cases as they are ejected out of the bottom of the machine gun MG, to the right as shown in the drawings, into the catch bag 22. This prevents the cases from bouncing back up into the gun MG, which could potentially cause a malfunction.

It is noted that the mount 10 is not recoil attenuated, i.e., it is a "hard" mount, in contrast to the attenuated, "soft" mount of the prior art mentioned above. In this regard, in a soft mount, the weapon is allowed to translate axially, i.e., along the axis of the barrel, and this means that the machine gun is constantly moving back and forth as the gun is being fired so that the hands and arms of the operator are moving back and forth as well. The hard mount construction of mount 10 eliminates this, thereby further enhancing accuracy.

In the preferred embodiment under consideration, the machine gun MG is stowed by folding the above-mentioned M144 arm (not shown) and rotating the arm into the window of the helicopter. As discussed above, the construction of mount 10 permits the gun MG to depress through an angle of 90 degrees, thereby enabling the gun MG to swing clear of the crew seat and to stow out of the way of the operator in an area between the operator and the pilot's seat.

It is also noted that the mount described above can be readily adapted to other airframes than that discussed previously. The bottom portion 14*a* of pintle 14, which is adapted to interface with the M144 arm as described hereinbefore, could require modification dependent on the interface requirements of the host aircraft platform.

Although the invention has been described above in relation to preferred embodiments thereof, it will be understood by those skilled in the art that variations and modifications can be effected in these preferred embodiments without departing from the scope and spirit of the invention.

What is claimed is:

1. A machine gun mount for mounting a machine gun in a movable support arm of a helicopter, said mount comprising:

a gun cradle adapted to be detachably connected to a machine gun;

a pintle including means at one end thereof adapted to pivotably mount the pintle, and thus the mount, on the movable support arm so as to enable pivoting movement of the mount, and thus a machine gun mounted in the gun cradle, in a horizontal plane, said pintle being pivotably connected at an opposite end thereof to said gun cradle so as to permit the gun cradle, and thus a machine gun mounted in the gun cradle, to be rotated in a vertical plane through 90 degrees between a first, operative position and a second, stowed position;

locking means for locking the gun cradle in the stowed position;

a magazine attached to one side of the gun cradle;

a spent case and link frame attached to the opposite side of the gun cradle;

a spent case and link catch bag connected to and supported by said frame; and a spent case and link deflector supported by said mount and disposed so as to deflect spent cases and links ejected from a machine gun mounted in the gun cradle away from the machine gun to one side thereof.

2. A device as claimed in claim 1 wherein said magazine includes a lower inwardly projecting portion disposed below said cradle.

3. A device as defined in claim 1 wherein said cradle includes first and second axially spaced mounting elements on said one side and said magazine includes a pair of mounting brackets secured to said mounting elements.

4. A device as defined in claim 1 wherein said gun cradle includes first and second transversely spaced lugs adapted to support a machine gun on the mount.

5. A device as defined in claim 4 wherein said gun cradle includes transversely spaced first and second mounting members extending oppositely from said first and second lugs for supporting said opposite end of said pintle.

6. A machine gun mount for mounting a machine gun in a movable support arm of a helicopter, said mount comprising:

a gun cradle adapted to be releasably connected to the machine gun;

a pintle including means at one end thereof adapted to pivotably mount the pintle, and thus the mount, on the movable support arm so as to enable pivoting movement of the mount, and thus a machine gun mounted in the gun cradle, in a horizontal plane, said pintle being pivotably connected at an opposite end thereof to said gun cradle so as to permit the gun cradle, and thus a machine gun mounted in the gun cradle, to be rotated in a vertical plane through 90 degrees between a first, operative position and a second, stowed position;

retaining means for retaining the gun cradle in the stowed position;

a magazine attached to one side of the gun cradle, said magazine including a lower inwardly projecting portion disposed below said cradle;

a spent case and link frame attached to the opposite side of the gun cradle; and a spent case and link bag connected to and supported by said frame.

7. A device as defined in claim 6 wherein said cradle includes first and second axially spaced mounting elements on said one side and said magazine includes a pair of mounting brackets secured to said mounting elements.

8. A device as defined in claim 6 wherein said gun cradle includes first and second transversely spaced lugs and at least one cooperating quick release pin adapted to releasably connect a machine gun to the mount.

9. A device as defined in claim 8 wherein said gun cradle includes transversely spaced first and second mounting members extending oppositely from said first and second lugs for supporting said opposite end of said pintle.

10. A machine gun mount for mounting a machine gun in a movable support arm of a helicopter, said mount comprising:

a gun cradle adapted to be detachably connected to a machine gun, said cradle including first and second axially spaced mounting elements on said one side and first and second transversely spaced lugs adapted to support the machine gun on the mount;

a pintle including means at one end thereof adapted to pivotably mount the pintle, and thus the mount, on the movable support arm so as to enable pivoting movement of the mount, and thus a machine gun mounted in the gun cradle, in a horizontal plane, said pintle being pivotably connected at an opposite end thereof to said gun cradle so as to permit the gun cradle, and thus a machine gun mounted in the gun cradle, in a horizontal plane, said pintle being pivotable connected at an opposite end thereof to said gun cradle so as to permit the gun cradle, and thus a machine gun mounted in the gun cradle, to be rotated in a vertical plane through 90 degrees between a first, operative position and a second, stowed position;

locking means for locking the gun cradle in the stowed position;

a magazine attached to one side of the gun cradle, said magazine including a lower inwardly projecting portion disposed below said gun cradle and said magazine further including a pair of mounting brackets secured to said mounting elements of said gun cradle;

a spent case and link frame attached to the opposite side of the cradle mount;

a spend case and link bag connected to and supported by said frame.

11. A device as defined in claim 10 wherein said gun cradle includes transversely spaced first and second mounting members extending oppositely from said first and second lugs for supporting said opposite end of said pintle.

12. A device as defined in claim 10 further comprising a spent case and link deflector supported by said mount and disposed so as to deflect spent cases and links ejected from a machine gun mounted in the gun cradle away from the machine gun to one side thereof.

* * * * *